United States Patent [19]

Yang

[11] Patent Number: 4,665,656

[45] Date of Patent: May 19, 1987

[54] FILTER APPARATUS FOR ABRASIVE TOOL

[76] Inventor: Tai-Her Yang, 5-1 Taipin St., Si-Hu Town, Dzan-Hwa, Taiwan

[21] Appl. No.: 910,278

[22] Filed: Sep. 17, 1986

Related U.S. Application Data

[63] Continuation of Ser. No. 707,388, Mar. 1, 1985, abandoned.

[51] Int. Cl.[4] ..... B24B 7/00; B24B 9/00; B24B 55/04; B24B 55/06

[52] U.S. Cl. ..... 51/72 R; 51/270; 51/273

[58] Field of Search ..... 51/72 R, 270, 425, 273; 55/244, 246, 245

[56] References Cited

U.S. PATENT DOCUMENTS

| | | | |
|---|---|---|---|
| 1,255,230 | 2/1918 | Roese | 51/270 |
| 2,373,330 | 4/1945 | Nutting | 51/273 |
| 3,651,607 | 3/1972 | Lee, II | 51/270 |
| 4,373,300 | 2/1983 | Partridge | 51/270 |
| 4,514,936 | 5/1985 | Hurtado | 51/270 |

*Primary Examiner*—Frederick R. Schmidt
*Assistant Examiner*—Maurina Rachuba
*Attorney, Agent, or Firm*—Leonard Bloom

[57] ABSTRACT

A bench grinder has a dust-collecting fan in a hood for the abrasive wheel. The dust-laden air passes from the hood through a conduit to a filter box mounted on the rear of the motor housing. The filter box has parallel first and second sidewalls, and the first sidewall has an inlet opening for the conduit. A pair of inclined guide plates are mounted in the filter box, including a first guide plate and a second guide plate. Each of the guide plates is a substantially solid integral member and has a lower surface provided with corrugations. An opening is formed in the first guide plate, remote from the air inlet opening and adjacent to the second sidewall of the filter box; and an opening is formed in the second guide plate, remote from the opening in the first guide plate and adjacent to the first sidewall of the filter box. The dust-laden air passes through these respective openings, and along the corrugated lower surfaces of respective the guide plates, and the dust particles fall down into the filter box.

12 Claims, 9 Drawing Figures

FILTER APPARATUS FOR ABRASIVE TOOL

This application is a continuation of application Ser. No. 707,388, filed Mar. 01, 1985, now abandoned.

BACKGROUND OF THE INVENTION

Bench grinders are widely used. However, since most of the currently used grinders do not have low-cost air filters, undesirable particles of iron bits are often dispersed to the air during use. This makes for a dirty shop, difficult cleaning, and a potential hazard to the respiratory organs of the user's health.

SUMMARY OF THE INVENTION

An improved anti-pollution design for grinders is proposed. The main feature of which is that at least one side of the drive motor spindle of the grinder has an extended shaft. A fan is provided on the extended end of the shaft. Another shell or cover (or hood) is installed to cover the fan and create a manifold. A through hole is provided in the hood, and a guide pipe or conduit is connected externally to a filter box. The filter box, which is behind the tool, is filled with water and provided with guide plates. When the grinder is in operation, the force produced by the flowing air of the fan entrains the small iron bits which are then delivered to the filter box for filtering and storage via the conduit. The small iron bits thus do not fly around causing pollution and endangering the operator's physical health.

DETAILED DESCRIPTION OF THE INVENTION

The improved pollution limiting design for grinders has been derived from studies and designs conducted in response to the known defects. The grinder is provided with a particle absorbing and filtering device to absorb and filter the iron or other bits produced during working, thereby eliminating the defects causing pollutions and hazards to the human physical health.

Figure 1:
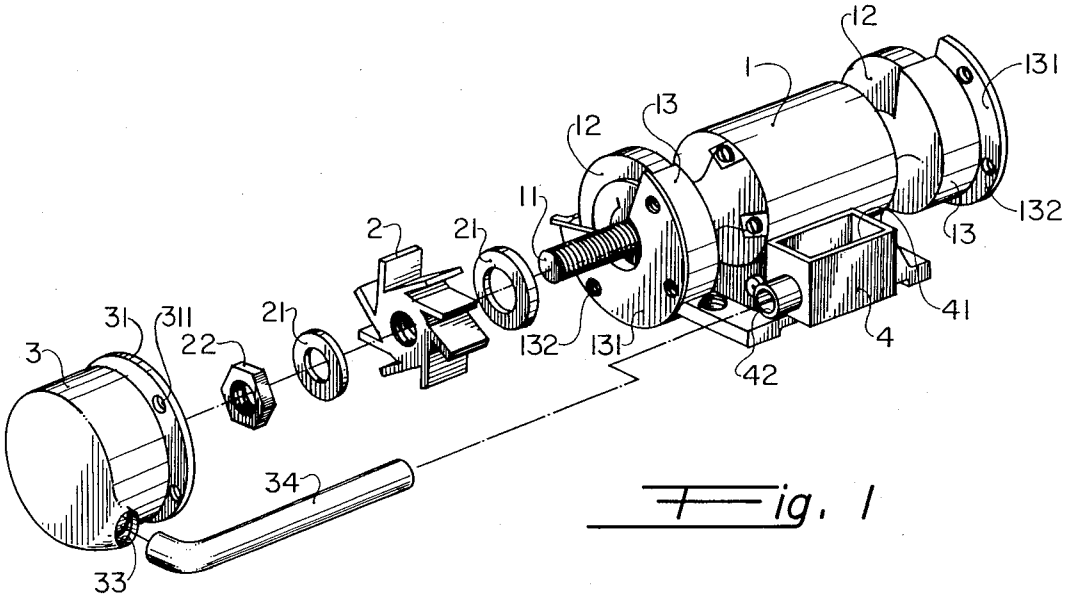
FIG. 1 is an exploded perspective view of the structure according to the present invention.
Figure 2:
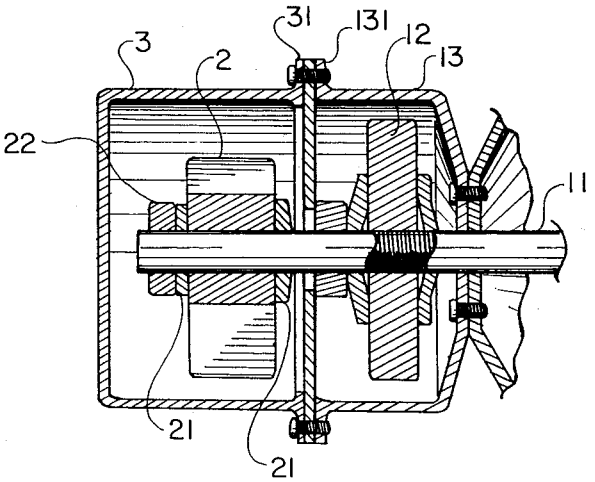
FIG. 2 is the cross-sectional view of the structural assembly of the fan according to the present invention.
Figure 5:
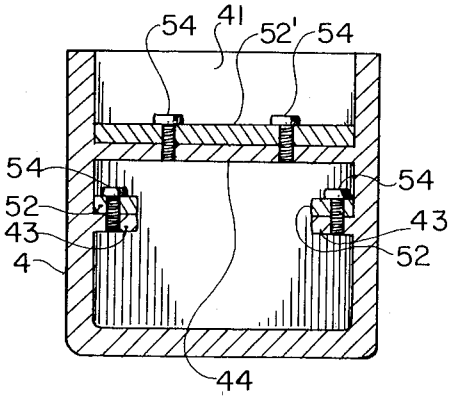
FIG. 5 is the cross-sectional view along line B—B in FIG. 3.
Figure 4:
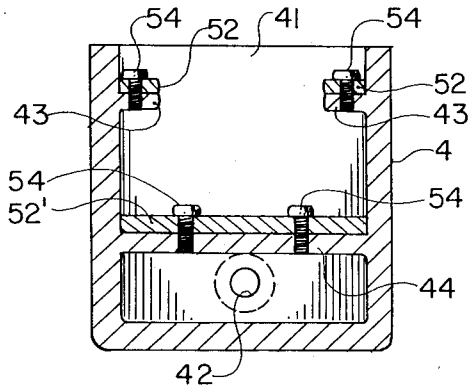
FIG. 4 is the cross-sectional view along line A—A in FIG. 3.

Now, the structure of the present invention is described, in detail, in conjunction with the examples illustrated in the attached drawings as follows:

As shown in FIG. 1, the present invention makes the spindle (11) of the drive motor (1) of the bench grinder or other tool extend a length out of the outside of the protective housing (13) of the grinding stone or other abrasive wheel (12). The spindle (11) is provided with threads in a direction opposite to the rotational direction of said drive motor (1). Several screw holes (132) are provided in the flange (131) on the side wall of the protective housing. On the spindle (11), two washers (21) clamp and hold both sides of a fan (2) which are then locked by a nut (22), thus making the fan (2) and spindle (11) fixed and coupled (as shown in FIG. 2). After fan (2) is positioned, an outer shell or hood (3) covers the fan (2), and several screw holes (311) are provided in the flange (2) on one side of the outer shell. Screws (32) are used to lock and join the outer shell (3) and grinder protective housing (13). A through hole or discharge opening (33) is provided as extending from the circumference of the outer shell (3). A guide pipe or conduit (34) is joined with the through hole (33). A detachable filter box (4) is provided at a proper place on the bottom of the grinder and has a hollow interior (41) to store and be filled with water. A through hole or inlet opening (42) is provided on the lower portion of the first side wall of the filter box (4) and then joined by the other end of the guide pipe or conduit means (34). The position of the filter box (4) is lower in height than the through hole (33) in the outer shell (3) to prevent the water in the filter box (4) from flowing back to the outer shell (3).

Figure 3:
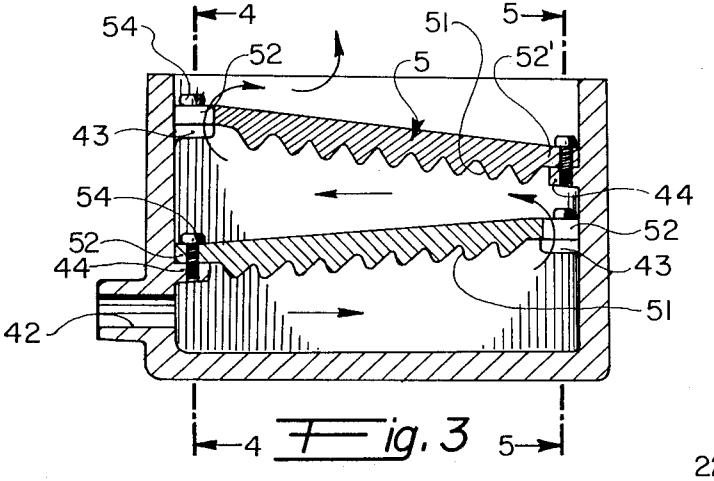
FIG. 3 is the cross-sectional view of the structural assembly of the filter box according to the present invention.
Figure 6:
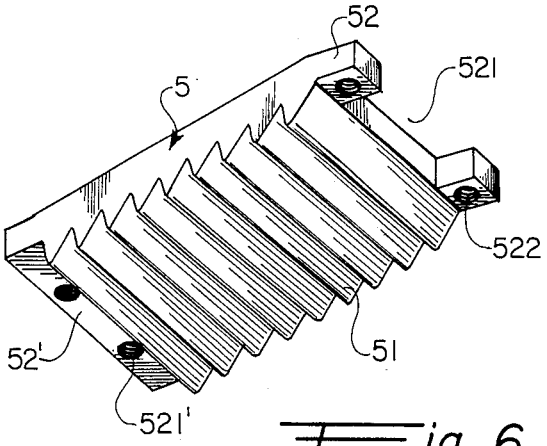
FIG. 6 is the perspective view of the guide plate provided in the filter box according to the present invention.
Figure 9:
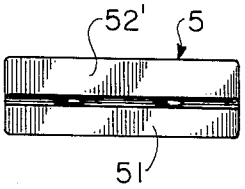
FIG. 9 is an end view of the guide plate according to the present invention.
Figure 8:
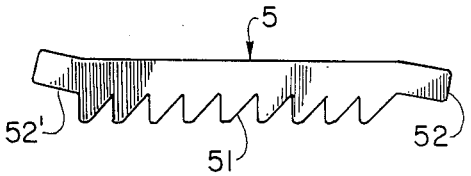
FIG. 8 is a side view of the guide plate according to the present invention.
Figure 7:
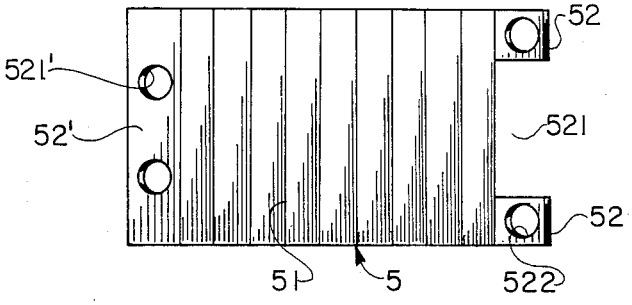
FIG. 7 is a top view of the guide plate according to the present invention.

The filter box (4) is shown in FIG. 3. Its side wall is provided with a through hole (42), and a set of fixed seats (43) and a fixed plate (44) are provided. The fixed seats (43) are separately provided on the two upper end corner parts on the side wall, while the fixed plate (44) is provided at a slightly lower position on the inner face of the side wall. Threaded holes are provided on the fixed seats (43) and fixed plate (44) respectively. Similarly, in the other (second) sidewall opposite to the first sidewall, similar fixed seats (43) and fixed plate (44) are also provided. The only differences are that the positions of the fixed seats (43) and fixed plate (44) are opposite and between the aforesaid fixed seats (43) and fixed plate (44). The fixed seats (43) and fixed plate (44) of the two side walls are to fix two guide plates (5) as shown in FIG. 6. The guide plates (5) are in a rectangular design in a width the same as the interior (41) of said filter box (4). Its bottom face is provided with a corrugated or toothed pattern (51) or other concave and convex patterns. Each of its two ends extends obliquely at a proper angle to form a plate (52) (52') respectively, between which there is an integral vent (521). A threaded hole (522) (521') is provided. When guide plate (5) is installed in the filter box (4), the toothed patterns or corrugations (51) face downward. The plates (52) (52') on their ends correspond to the aforesaid fixed seats (43) and fixed plate (44), respectively, and lock in position by a screw (54). After plate (5) is assembled and positioned, it is like that shown in FIG. 3; i.e., positioning seat (43) and plate (52) are mutually locked, and positioning plate (44) and plate (52') are mutually locked. Since opposed vents (521) is provided, a circuitous path is formed.

This invention utilizes a fan (2) to entrain particles and then guide and deliver them to the filter box (4) for filtering and storage. Its working principle is that when the drive motor (1) of the grinder is started, a strong flow is produced to draw off the dust-laden air and to entrain all the dust particles produced during the grinding process, sending them to the filter box (4) via through hole (33) and guide pipe (34). Water is filled and stored in the filter box. After dirty matters like iron bits enter the filter box (4) from its under side, they are mixed with water and turned with water bubbles.

The guide plates (5) are provided in said filter box (4). The lower or bottom face of the guide plates (5) each has a corrugated pattern. Water bubbles and dirty matter floats upward and gradually and are pushed upward by the circuitous guide channel formed between said guide plates (5). Particles are also trapped between the toothed patterns on the bottom of said guide plates. The heavier iron bits are deposited at the bottom of the filter box (4). After the filter box is used for a period of time, it is removed from the grinder or tool, then the guide plates (5) are removed for cleaning.

From the above description, the device under this invention is simple in structure and can precisely exploit the expected anti-pollution function, thus assuring the operators' physical health and protecting the environment.

What is claimed is:

1. In a tool having an abrasive wheel mounted on a spindle driven by a motor, a filter attachment comprising a fan mounted on the spindle adjacent to the wheel; a hood mounted on the tool and substantially enclosing the fan, the hood having a discharge opening formed therein; a filter box mounted on the tool rearwardly of the motor, the filter box having first and second walls, the first wall having an inlet opening formed therein; conduit means for conducting air and entrained particles removed by the guiding wheel between the discharge opening in the hood and the inlet opening in the filter box, the conduit means being disposed rearwardly of the hood; at least one solid guide plate mounted in the filter box above the inlet opening therein, the solid guide plate extending from the inlet opening in direction of the second wall and defining a substantially horizontally extending collecting chamber of increasing vertical cross-section in direction of air flow between the first wall and the second wall, the guide plate having a lower downwardly facing surface provided with corrugations and a single outlet opening of reduced cross-section relative to maximum vertical cross-section of the collecting chamber formed therein and only at one end thereof remote from the inlet opening in the filter box and substantially adjacent to the second wall of the filter box, wherein the air containing the entrained particles created by the abrasive wheel during operation of the tool is drawn by the fan and passes through the hood and the conduit means and into the collecting chamber of the filter box, wherein the particle-laden air travels substantially horizontally through the chamber along the downwardly facing surface of the guide plate in the collecting chamber of increasing cross-section and is precluded from passing through the solid guide plate and wherein the air exits through the single opening of reduced cross-section in the solid guide plate, whereby the larger particles in the air are substantially filtered out by the corrugations on the downwardly facing surface of the solid guide plate and the collecting chamber of increasing cross-section and drop down into the filter box for convenient removal.

2. The filter attachment of claim 1, wherein the solid guide plate is inclined upwardly from the inlet opening in the filter box.

3. The filter attachment of claim 2, further including a further solid guide plate in the filter box above the first-said solid guide plate, the second solid guide plate being inclined upwardly from the single outlet opening in the first-said guide plate and having an opening formed therein at its opposite end, whereby the air travels through a circuitous generally horizontal path in the filter box.

4. The filter attachment of claim 3, wherein the second solid guide plate has a downwardly facing surface provided with corrugations.

5. The filter attachment according to claim 1, wherein the filter box is adapted to hold water below the level of the inlet opening.

6. In an abrasive tool having a housing, a motor in the housing, the motor having a spindle, and an abrasive wheel mounted on the spindle, the improvement which comprises a filter box mounted on the motor housing, the filter box havng first and second endwalls and the first endwall having an air inlet opening formed therein; means between the abrasive wheel and the air inlet opening in the filter box for collecting air having entrained particles removed by the abrasive wheel and delivering same to the filter box; and a pair of solid guide plates mounted within the filter box including a first solid guide plate inclined upwardly in the filter box above the inlet opening in the first endwall in the direction of the second wall to define a first substantially horizontal collection chamber of increasing vertical cross-section in the direction of air flow and a second solid guide plate disposed above the first solid guide plate and inclined upwardly in the filter box in a direction opposite to the inclination of the first guide plate to define a second substantially horizontal collecting chamber of increasing vertical cross-section in the direction of air flow, each of the guide plates having a respective downwardly facing surface provided with corrugations, the first solid guide plate having a single outlet opening of reduced cross-section relative to the maximum vertical cross-section of the first collecting chamber formed therein substantially adjacent to the second endwall of the filter box and remote from the air inlet opening in the filter box, the second guide plate having a single outlet opening of reduced cross-section relative to the maximum vertical cross-section of second collecting chamber formed therein substantially adjacent to the first endwall of the filter box remote from the opening of reduced cross-section in the first solid guide plate, wherein the particle-laden air from the means between the abrasive wheel and the air inlet opening passes into the air inlet opening in the filter box, travels substantially horizontally through the second collecting chamber along the downwardly facing corrugated surface of the second solid guide plate and exits out of the opening of reduced cross-section in the second solid guide plate adjacent to the first end wall of the filter box.

7. The improvement according to claim 6, wherein the filter box is adapted to hold water below the level of the inlet opening.

8. In a tool having an abrasive wheel mounted on a spindle driven by a motor; a fan mounted on the spindle adjacent to the wheel; a hood substantially enclosing the fan, the hood having a discharge opening formed therein; a filter box, the filter box having first and second walls and the first wall having an inlet opening formed therein, and conduit means for conducting air and entrained particles removed by the guiding wheel between the discharge opening in the hood and the inlet opening in the filter box, an improvement comprising at least one solid guide plate mounted in the filter box above the inlet opening therein, the solid guide plate extending from the inlet opening in direction of the second wall and defining a substantially horizontally extending collecting chamber of increasing vertical cross-section in direction of air flow between the first wall and the second wall, the guide plate having a downwardly facing surface provided with corrugations and a single outlet opening of reduced cross-section relative to maximum vertical cross-section of the collecting chamber formed therein and only at one end thereof remote from the inlet opening in the filter box and substantially adjacent to the second wall of the filter box, wherein the air containing the entrained particles created by the abrasive wheel during operation of the tool is drawn by the fan and passes through the hood and the conduit means and into the collecting chamber of the filter box, wherein the particle-laden air travels substantially horizontally through the chamber along the downwardly facing surface of the guide plate in the collecting chamber of increasing cross-section and is precluded from passing through the solid guide plate and wherein the air exits through the single opening of reduced cross-section in the solid guide plate, whereby the larger particles in the air are substantially filtered out by the corrugations on the downwardly facing surface of the solid guide plate and the collecting chamber of increasing cross-section and drop down into the filter box for convenient removal.

9. The improvement of claim 8, wherein the solid guide plate is inclined upwardly from the inlet opening in the filter box.

10. The improvement of claim 9, further including a further solid guide plate in the filter box above the first-said solid guide plate, the second guide plate being inclined upwardly from the single opening in the first guide plate and having an opening formed therein at its opposite end, whereby air travels through a circuitous generally horizontal path in the filter box.

11. The improvement of claim 10, wherein the second guide plate has a downwardly facing surface provided with corrugations.

12. The improvement of claim 8, wherein the filter box is adapted to hold water below the level of the inlet opening.

* * * * *